United States Patent [19]

Daboudet et al.

[11] Patent Number: 4,596,091

[45] Date of Patent: Jun. 24, 1986

[54] GRINDING MACHINE FOR FORMING THE EDGE OF AN OPHTHALMIC LENS

[75] Inventors: Pascal Daboudet, Paris; Bernard Cousyn, Vincennes, both of France

[73] Assignee: Essilor International Cie Generale d'Optique, Creteil, France

[21] Appl. No.: 592,259

[22] Filed: Mar. 22, 1984

[30] Foreign Application Priority Data

Mar. 22, 1983 [FR] France ..... 83 04637

[51] Int. Cl.[4] ..... B24B 17/00

[52] U.S. Cl. ..... 51/101 LG; 51/284 E; 51/165.75; 409/99

[58] Field of Search ..... 51/101 LG, 165.71, 165.75, 51/165.76, 284 R, 284 E, 165.78, 165.79; 409/98, 99

[56] References Cited

U.S. PATENT DOCUMENTS

| | | | |
|---|---|---|---|
| 2,559,431 | 7/1951 | Hollengreen et al. | 51/165.75 X |
| 2,639,562 | 5/1953 | Balsiger | 51/165.75 X |
| 3,112,583 | 12/1963 | Koppenwallner | 51/105 R X |
| 3,332,172 | 7/1967 | Stern | 51/101 LG |
| 3,769,755 | 11/1973 | Kania et al. | 51/101 LG |
| 4,394,099 | 7/1983 | Santinelli | 51/101 LG X |
| 4,423,569 | 1/1984 | Stern et al. | 51/101 LG |

FOREIGN PATENT DOCUMENTS

| | | |
|---|---|---|
| 2211865 | 9/1973 | Fed. Rep. of Germany . |
| 2475446 | 8/1981 | France . |
| 2481635 | 11/1981 | France . |
| 2499442 | 8/1982 | France . |
| 2068797 | 8/1981 | United Kingdom . |

*Primary Examiner*—Robert P. Olszewski

*Attorney, Agent, or Firm*—Charles E. Brown; Charles A. Brown

[57] ABSTRACT

In a method for bevelling an ophthalmic lens, the lens is rotated about its own axis and is also displaced parallel to its axis as a function of its angle of rotation. Simultaneously, the edge of the lens is kept in contact with a grinding wheel. Thus the point of contact of the lens with the grinding wheel is constrained to follow a specific path. The specific path to be followed by the point of contact is an intermediate path selected between two paths resulting from a comparison between a collection of predetermined paths and two reference paths. The reference paths are each obtained from a plotting operation carried out prior to the bevelling operation on the ophthalmic lens using feelers. This method is used in grinding machines such that trimming and bevelling of ophthalmic lenses can be automatically performed.

7 Claims, 7 Drawing Figures

GRINDING MACHINE FOR FORMING THE EDGE OF AN OPHTHALMIC LENS

BACKGROUND TO THE INVENTION

The present invention relates to a method of forming the edge of an ophthalmic lens, and in particular to a method of bevelling ophthalmic lenses. The invention also relates to a machine for grinding ophthalmic lenses.

As is known, bevelling is an operation which involves forming a rib or bevel, generally of triangular cross-section, on the peripheral edge of an ophthalmic lens. This rib or bevel is to be engaged in a groove, generally called a bezel, in the ring or surround of a spectacle frame in order to retain the lens therein.

Usually, the bevelling operation is preceded by a trimming or routing operation in which the superfluous peripheral part of the ophthalmic lens is removed to match the contour of the lens periphery, which is, in general, circular, to that of the circle or surround of the spectacle frame in which the lens is to be mounted.

Usually, these trimming and bevelling operations are carried out in succession on one grinding machine which is equipped with a set of suitable grinding wheels.

In practice, such a grinding machine comprises a machining station equipped with at least one trimming wheel and with at least one bevelling wheel, each of said wheels being rotatable by way of a drive motor, and a carriage which carries spindles extending parallel to the axis of said grinding wheels. The spindles are arranged to axially clamp the lens and they are mounted for rotation by way of a further drive motor. The carriage is mounted on a chassis for movement transversely relative to the axis of the grinding wheels and for movement axially parallel to the axis of these grinding wheels. Suitable control means for controlling the movement of the carriage are provided.

The transverse displacement of the carriage relative to the axis of the grinding wheels is necessary to bring the ophthalmic lens into contact with the wheels. This displacement can be enabled, for example, by pivotably mounting the carriage on a shaft extending parallel to the axis of the grinding wheels or by mounting the carriage such that it is movable perpendicularly to the axis.

Preferably, the carriage is biassed towards the axis of the grinding wheels either by gravity, or, if appropriate, by elastic means.

The axial displacement of this carriage enables the ophthalmic lens to be brought successively to each of the different grinding wheels.

The trimming operation, which is intended simply to form a cylindrical edge on the ophthalmic lens, is usually carried out under the control of a template. At present the contour of the template corresponds to the contour of the ring or surround of the spectacle frame in which the lens is to be mounted. The template is fixedly mounted on one of the spindles clamping the ophthalmic lens, and is arranged to cooperate with a key which limits the transverse penetrating movement of the trimming wheel relative to the lens.

During the trimming operation, the edge of the ophthalmic lens is kept in contact with the trimming wheel. Whatever the characteristics of the ophthalmic lens, it is generally sufficient to rotate the lens about its own axis which is arranged to extend parallel to the axis of the trimming wheel.

The bevelling operation is not so easily carried out, especially as there is a need to take the particular curvature of one and/or the other of the faces of the ophthalmic lens into account. This is particularly true for so-called progressive lenses where the front face of the lens is not spherical and the lens has a vertical meridian along which the power is progressively variable.

It is, of course, important that the bevel formed during the bevelling operation should be on the actual edge of the lens between the angles of its periphery.

It is therefore necessary to displace the lens parallel to its axis during its rotation, so that its point of contact with the bevelling wheel follows a suitable path between the said angles.

Thus, in order to enable the particular curvature of the ophthalmic lens to be taken into account, the lens must be capable of being displaced parallel to its axis during its rotation.

Such axial or lateral displacement of the lens can be carried out manually. However, it is then necessary for the operator to have a certain dexterity as the positioning of the lens is carried out visually.

Consequently, the result is always relatively approximate.

Alternatively, the ophthalmic lens can be laterally displaced by way of a guide wheel with a double slope defining a groove into which the entire edge of the lens penetrates. The guide wheel therefore automatically centres the lens permanently.

However, where ophthalmic lenses having thick edges are to be treated, the width which such a double-slope bevelling wheel must possess can quickly become prohibitive.

Moreover, to ensure that the lens can be freely displaced axially, it is necessary for the spindles clamping the lens to be perfectly balanced. This implies that the stand or chassis on which the spindles are mounted must be placed at a suitable level.

Consequently, it has been proposed in automatic grinding machines that the axial displacement of the ophthalmic lens to be bevelled should be controlled by control means such that the point of contact of the lens with the bevelling wheel follows a specific path.

French published Patent Application No. 2,481,635, describes an apparatus in which the key associated with the template is mounted so as to be transversely movable relative to the support spindles under the control of a control unit. This control unit provides a limited number of possible bevel paths, for example three or four, from which the operator can select the one which appears to him to be the most suitable.

However, as previously, it is necessary for the operator to be a specialist.

French published Patent Application No. 2,475,446, describes an apparatus by which bevelling is carried out in two stages. In the first stage, which is a pre-bevelling operation carried out by means of a double-slope bevelling wheel, the control unit detects the axial displacement of the lens during the bevelling operation as a function of its angle of rotation about its axis and records the path followed by the bevel of this lens. The axial displacement of the lens takes place freely for the reasons mentioned above.

In the second stage, which is a bevelling operation for finishing the lens, the control unit systematically ensures that the axial displacement of the lens corresponds to the previously recorded bevel path.

Of course, if the pre-bevelling operation, from which the bevel path has been recorded, has not been correctly performed, the bevel finally produced is not satisfactory.

In addition, and as previously, it is necessary to use a double-slope bevelling wheel which of course has the abovementioned disadvantages as regards bulk.

SUMMARY OF THE INVENTION

It is an object of the present invention to provide an apparatus which reduces the disadvantages briefly described above, and makes it possible to provide a completely automatic grinding machine which, in particular, is able to take into account the particular characteristics of the ophthalmic lenses to be treated.

According to the first aspect of the present invention there is provided a method of forming the edge of an ophthalmic lens comprising maintaining said edge of the ophthalmic lens in contact with a grinding wheel, rotating the lens about a first axis parallel to the axis of the said grinding wheel, and simultaneously displacing the lens parallel to the said first axis as a function of its angle of rotation relative to said first axis such that the point of contact of the lens with said grinding wheel follows a specific path, wherein before the lens is formed a plotting operation is carried out thereon to describe two reference paths, one of which corresponds to a zone of the front face of the lens and the other of which corresponds to a zone of the rear face of the lens, and wherein said specific path for the point of contact is an intermediate path selected between two paths resulting from a comparison between said two reference paths and a collection of predetermined paths.

Thus, in the method of the invention, a plot is first made of reference paths made directly on the ophthalmic lens. Subsequently an intermediate bevel path between the previously plotted reference paths is selected from a collection of possible predetermined bevel paths.

The particular characteristics of the lens are thus systematically taken into account, and the lens bevel which can be made, automatically if required, is therefore placed correctly between the angles of its periphery with absolute reliability.

Preferably, the reference paths are plotted point by point. In addition, the zones of the faces of the lens are in practice both located in line with the vertex of the bevel to be formed.

According to a further aspect of the present invention there is provided a grinding machine for ophthalmic lenses, comprising a chassis, a machining station supported on the chassis, at least one grinding wheel rotatably mounted at the machining station, a first drive motor for rotating said grinding wheel, a carriage slidable relative to the chassis, two rotatable spindles arranged to axially clamp the lens carried by the carriage and extending parallel to the axis of said grinding wheel, a second drive motor for rotating the spindles, a control unit for controlling movement of said carriage on said chassis transversely relative to the axis of the grinding wheel and axially parallel to the axis of the grinding wheel, a template fixed on one of the spindles, and a key which is arranged to be kept in contact with the said template and is mounted to be movable transversely relative to said spindles by way of said control unit, and wherein a reading station is associated with said machining station, said reading station comprising two feelers arranged to contact respectively the front face and the rear face of the lens, said feeders being mounted so as to be movable parallel to said spindles and two receivers which are responsive to the displacements of the said feelers and arranged to communicate with said control unit.

In known manner, the template used can correspond to the contour of the circle or surround of the spectacle frame in which the ophthalmic lens in question is to be mounted.

Alternatively, such a template may be replaced by simple circular disc in combination with control means arranged to impose on the key a specific position as a function of the angle of rotation of the disc about its axis.

For example, the control means can comprise to at least one prerecorded instruction carrier to which the control unit of the machine is responsive.

Thus, a template which physically copies the contour of the surround is replaced by a template on which information as to the shape of the contour is recorded. The displacements of the key caused as a function of the recorded information enable the physical contour to be recreated.

The usefulness of apparatus of the invention will be appreciated more clearly if it is remembered that presently practitioners must have at their disposal as many templates as there are possible contours for the rings or surrounds to receive the lenses normally available. The large number of such contours has previously resulted in substantial costs. Furthermore, for each ring or surround which is to receive a lens, the corresponding template has had to be put in place on the grinding machine and subsequently removed from it, thus requiring operations which are inevitably expensive.

With a recorded template, since the circular contour disc is permanently on the grinding machine, the only operation to be carried out is that which involves introducing into the control unit the appropriate prerecorded instruction carrier or selecting the appropriate guidance instructions on a carrier already in the said control unit.

The trimming operation is simplified as a result.

Preferably, the grinding machine is automatic.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

The present invention is concerned with operations to trim and bevel an ophthalmic lens 10, the front face 11A and/or the rear face 11B of which can have any curvature.

Figure 4:
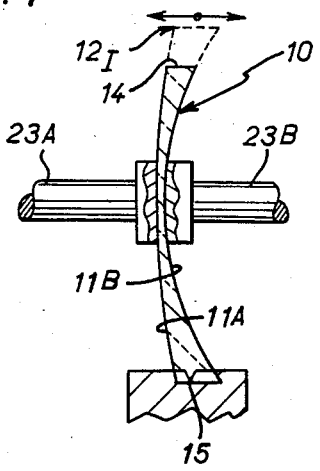
FIG. 4 shows a view similar to that of FIG. 2 during bevelling of an ophthalmic lens.
Figure 5:
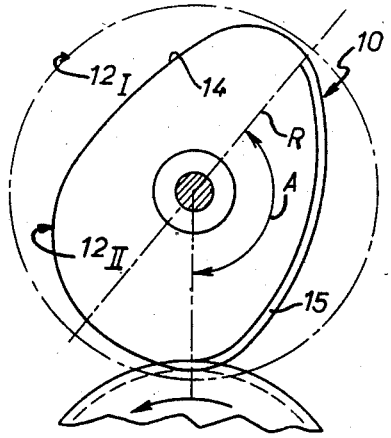
FIG. 5 shows a side view taken on arrow V in FIG. 4 of the ophthalmic lens during bevelling.

Initially, the contour of the periphery of the ophthalmic lens 10 is usually circular, as indicated by broken lines $12_I$ in FIGS. 4 and 5.

By means of a trimming operation, this contour is to be matched to that of a spectacle frame or surround in which the lens is to be mounted. In FIG. 5 the contour of the frame or surround is shown by solid lines $12_{II}$.

Furthermore, by means of a bevelling operation, an annular rib or bevel 15 is formed so as to project radially outwardly of the edge 14 of the ophthalmic lens. This rib or bevel 15, which is preferably triangular in cross-section is arranged to interlock with a groove or bezel provided in the spectacle frame or surround.

Figure 1:
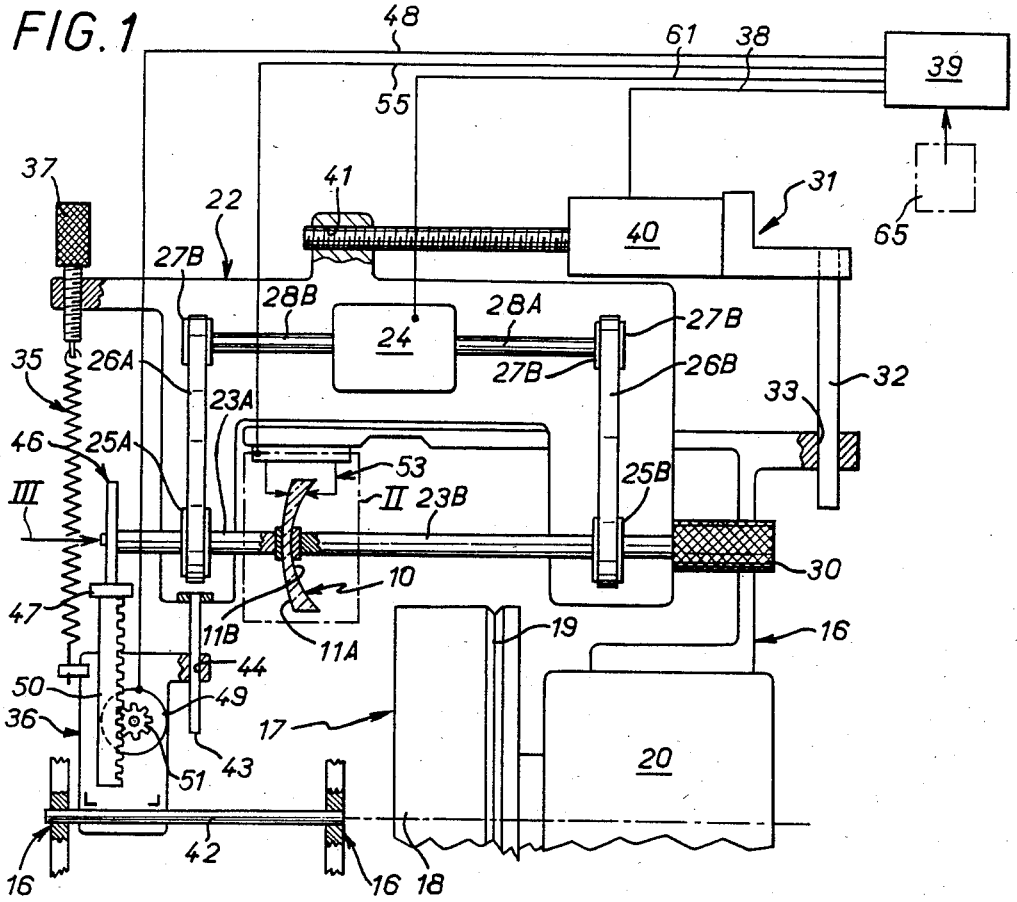
FIG. 1 shows an end elevation, partly broken away, of a grinding machine of the invention.

A grinding machine designed to carry out these trimming and bevelling operations is illustrated in FIG. 1 and comprises a chassis 16 to which is fixed a machining station 17 equipped with suitable grinding wheels.

The chassis 16, which a person skilled in the art is capable of constructing and which is not a part of the present invention, is not further described herein. Components of the chassis which appear in the Figures have been indiscriminately identified by the reference 16.

In the embodiment illustrated, a trimming wheel 18 and a bevelling wheel 19 are provided at the machining station 17. Of course, the number of grinding wheels actually used at this machining station 17 can vary, and in practice any number of grinding wheels can be provided.

The trimming wheel 18 is a cylindrical wheel, whilst the bevelling wheel 19 has a groove which, in the embodiment illustrated, is of triangular cross-section.

The grinding wheels 18 and 19 are each rotatably mounted on one and the same support shaft fixed on the output shaft of a drive motor 20 carried by the chassis 16. The grinding wheels 18 and 19 are axially spaced along the support shaft and are fixed for rotation therewith.

For the retention of an ophthalmic lens 10, the grinding machine includes a carriage 22 having two spindles 23A, 23B which each extend parallel to the axis of the grinding wheels 18 and 19. The spindles 23A, 23B are arranged to clamp an ophthalmic lens 10 axially and which are mounted to be rotatable by way of a drive motor 24 carried by the carriage 22.

In practice, this drive motor 24 is preferably a stepping motor.

As indicated in FIG. 1, the support spindles 23A and 23B are fixed for rotation with pulleys 25A and 25B which are rotatably mounted on the carriage 22. By means of belts 26A and 26B and of further pulleys 27A and 27B likewise rotatably mounted on the carriage 22, the pulleys 25A and 25B are constrained to rotate in a synchronous manner with opposite ends 28A, 28B of the output shaft of the motor 24.

The support spindle 23B is arranged to be moved axially towards the support spindle 23A with which it is associated in order to axially clamp the ophthalmic lens 10. This movement of the support spindle 23A can be effected by means of a knurled knob 30.

Alternatively, axial movement of the spindle 23B can be effected by any other suitable means, for example, by way of a jack.

The carriage 22 is mounted so as to be movable on the chassis 16 transversely relative to the axis of the grinding wheels 18, 19 under the control of bearing means urging it towards the said axis.

In the embodiment illustrated in FIG. 1, the carriage 22 is carried by a bracket 31, the foot 32 of which is slidably engaged in a passage 33 in the chassis 16.

Alternatively, the carriage 22 could be pivotably mounted on a support shaft extending parallel to the axis of the grinding wheels 18, 19.

In practice, the bearing means urging the carriage towards this axis may simply comprise gravity, the weight alone of the carriage providing the necessary force.

However, in the embodiment of FIG. 1, elastic restoring means, which comprise a spring 35 arranged between the carriage 22 and a block 36 integral with the chassis 16 are provided. The tension of the spring 35 can be adjusted by way of a knurled knob 37.

In addition, the carriage 22 is mounted so as to be movable axially on the chassis 16 parallel to the axis of the grinding wheels 18 and 19 under the control of a control unit 39 as indicated by the line 38.

In this respect, movement of the carriage 22 is effected by way of servo-motor 40 which is carried by the bracket 31. The output shaft of the servo-motor 40 is screwthreaded and is engaged into a threaded bore 41 provided in the carriage 22.

Preferably, the servo-motor 40 is a stepping motor.

To ensure that the block 36, to which the restoring spring 35 is attached, can follow the carriage 22, this block 36 is slidably mounted on a bar 42 integral with the chassis 16. The block 36 has a bore 44 in which a column 43 carried by the carriage 22 is slidably engaged.

The grinding machine illustrated incorporates a template 46 which is fixed against rotation on one of the support spindles 23A or 23B. In the embodiment illustrated, the template 46 is carried by the spindle 23A. A key 47, which is kept in contact with the template 46, is mounted so as to be movable transversely of said spindles under the control of said control unit 39, as indicated by the line 48.

In the embodiment illustrated in FIGS. 1 to 5, the contour of the periphery of the template 46 is the image of that of the spectacle frame or surround in which the lens is to be mounted.

Movement of the key 47 is effected by way of a servo-motor 49 carried by the block 36, the said key 47 being carried by a rack 50 with which a pinion 51 engages, the pinion 51 being fixed to the output shaft of this servo-motor 49. This servo-motor 49 is also preferably a stepping motor.

A reading station 53 is associated with the machining station 17.

In the embodiment illustrated in FIGS. 1 to 5, this reading station 53 is an integral part of the grinding machine.

Figure 2:
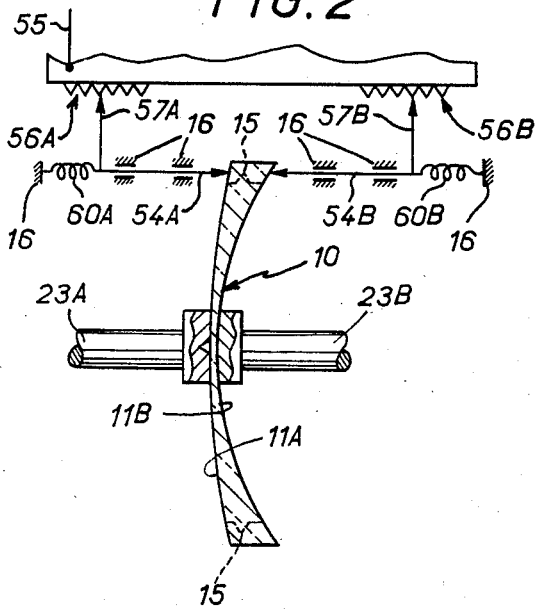
FIG. 2 shows on an enlarged scale the detail of FIG. 1 within the area identified II.
Figure 3:
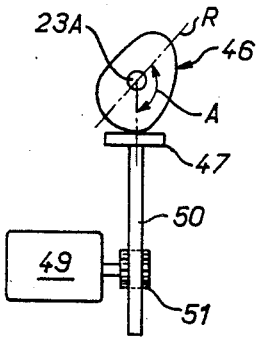
FIG. 3 shows a partial side view of the grinding machine taken in the direction of arrow III of FIG. 1.

As can be seen more clearly in FIG. 2, the reading station 53 comprises two feelers 54A and 54B which form sensors and which are arranged such that one feeler 54A contacts the front face 11A of the lens 10 to be bevelled and the other feeler 54A contacts the rear face 11B of the lens 10. The feelers 54A and 54B are mounted so as to be movable on the chassis 16 parallel to the spindle 23A and 23B which clamp the lens 10. Two receivers 56A and 56B which are each sensitive to the displacement of a respective one of the feelers 54A and 54B are provided and are connected to the control unit 39 as indicated by the line 55.

The construction of the feelers 54A and 54B is not a feature of the present invention and is not therefore further described herein. Preferably, each of the feelers 54A, 54B is connected to the slide 57A, 57B of a respective potentiometer constituting the associated receiver 56A, 56B.

The two feelers 54A and 54B are preferably located opposite one another, and the corresponding zones of the ophthalmic lens 10 are located in line with the vertex of the bevel 15 to be formed.

In the embodiment illustrated in FIGS. 1 to 5, the two feelers 54A and 54B are each individually mounted so as to slide on the chassis 16. Preferably, as indicated in FIG. 2, the chassis 16 defines the feelers 54A and 54B.

Before a bevelling operation, and preferably, before a preceding trimming operation, is commenced, the feelers 54A and 54B are moved in direct contact with the ophthalmic lens 10 so as to conform to the corresponding template 46 to describe two reference paths following the contour to be given to the lens. One of the reference paths corresponds to the zone of the front face whilst the other of the reference paths corresponds to the zone of the rear face of the said lens, and said paths are located in line with the said contour.

In an embodiment, this preliminary plotting or reading operation is carried out in the following way.

The ophthalmic lens 10 to be treated is axially clamped between the support spindles 23A and 23B at the reading station 53 and the template 46 corresponding to the contour to be given to this ophthalmic lens 10 is put in place. The rack 50 which controls movement of the key 47 is locked in position by means of the corresponding servo-motor 49, and the feelers 54A and 54B are brought into contact respectively with the front face 11A and the rear face 11B of the ophthalmic lens 10.

The feelers 54A and 54B are elastically biassed into contact with the ophthalmic lens 10, for example by means of springs 60A and 60B fixed to the chassis 16 as shown in FIG. 2.

The ophthalmic lens 10 is then rotated by way of the drive motor 24.

As the lens is rotated, the feelers 54A and 54B are moved axially and this movement is sensed by the receivers 56A and 56B and transmitted to the control unit 39 where the information is recorded and stored in memory. The axial movement of the feelers is proportional to the rotation of the lens and is caused by the curvature of the lens in line with the zones of the lens with which the feelers are in contact.

As a corollary to this, the angular indexation of these axial movements, and more precisely the plotting of these relative to the relevant zones of the ophthalmic lens 10, takes place in relation to a reference line or line of origin R of the lens. The drive motor 24 is advantageously a stepping motor and thus can itself constitute a suitable time base for defining the timing.

The corresponding plot transmitted to the control unit 39, as indicated schematically by the line 61 in FIG. 1, is recorded and stored thereby.

The combination of the two recordings made in this way provides, for each of the feelers 54A and 54B, a plot of a reference path linked to the curvature of the corresponding face 11A, 11B of the ophthalmic lens 10.

In practice, the reference paths obtained in this way are plotted point by point.

For example, two hundred points can be sufficient.

However, the present invention is not restricted to the number of points used in plotting a particular reference path.

In addition to the means arranged to reconstruct reference paths from the recordings made and to store these, the control unit 39 includes a memory in which a limited number of specific typical paths can be permanently stored point by point.

The number of typical paths stored in this way in the control unit 39 can, for example, be between fifteen and twenty five, but as before such a number must in no way be considered as limiting the present invention.

The control unit 39 also incorporates means arranged to compare the range of stored specific typical paths with the two reference paths plotted, as described above, on the ophthalmic lens 10 to be treated.

The control unit 39 also includes means arranged to select from the collection of stored typical paths an intermediate path between the reference paths previously plotted on the ophthalmic lens 10.

The construction of a control unit arranged to perform the abovementioned functions does not form part of the present invention. It is within the capabilities of a person skilled in the art, and components of different types can be used to provide the desired functions.

Generally, a central storage and computation unit is provided and is associated with an input interface to receive signals coming from the sensors and an output interface for controlling the motors.

The carriage 22 is raised by the servo-motor 49 and is then displaced axially by means of the servo-motor 40 to transfer the ophthalmic lens 10 from the reading station 53 to the machining station 17.

In a first stage, the ophthalmic lens 10 is aligned with the trimming wheel 18 and the carriage 22 is lowered under the control of the servo-motor 49. The ophthalmic lens 10 is then trimmed according to the contour of the template 46.

During this substantially conventional trimming operation, the servo-motor 49 is locked so as to maintain the key 47 in a fixed position relative to the chassis 16.

After the ophthalmic lens 10 has been trimmed, it is aligned with the bevelling wheel 19 by movement of the carriage 22.

The control unit 39 is then arranged to operate the servo-motors 40 and 49 such that a path corresponding to the selected intermediate path is reconstructed for the point of contact of the ophthalmic lens 10 with the bevelling wheel 19 by means of a combination of axial and transverse movements of the carriage 22.

This ensures that the bevel 15 formed is actually located between the angles of the periphery of the ophthalmic lens 10.

The servo-motor 49 is arranged to raise and lower the carriage 22 as necessary, and in particular it raises the carriage during axial transfers to the ophthalmic lens 10 to be treated. It is also able to provide compensation for wear of the grinding wheels 18 and 19.

In addition, the servo-motor 49 makes it possible to ensure angular indexation, from a floating zero, of the ophthalmic lens 10 about its axis of rotation. This enables greater accuracy to be achieved in the finishing of the lens and prevents needless machining passes capable of altering its angular parts.

The servo-motor 40 is arranged to transfer the ophthalmic lens 10 from one grinding wheel 18, 19 to the other, and it is also able to provide axial indexation of the lens 10 parallel to the axis of the grinding wheels, with zero resetting relative to the servo-motor 49.

As the servo-motors 39 and 40 are stepping motors, it is possible to work in an open loop, the said motors acting as both control devices and position-checking devices. It is thus unnecessary to provide position-reading devices for the ophthalmic lens 10.

Of course, a reducer can be associated with the drive motor 24, to increase the machining accuracy of the ophthalmic lens treated and thus make its form smoother.

As will be noted, the feelers 54A and 54B supply an axial dimension, and by a comparison the thickness of the lens 10 is known at any point of its contour.

It is this which makes it possible, in practice, to include a bevel on its edge.

Figure 6:
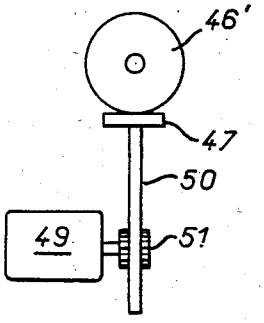
FIG. 6 shows a view similar to that of FIG. 3 of a further embodiment of a grinding machine of the invention.

The embodiment of the invention illustrated in FIG. 6 uses the servo-motor 49 such that it is possible to substitute a round template formed from a simple circular disc 46' for the shaped template 46 used previously. In this respect the control unit is arranged to operate the servo-motor 49 such that a specific position is imposed on the key 47 which is a function of the angle of rotation of this disc 46' about its axis of rotation.

The control unit is arranged to respond to at least one pre-recorded instruction carrier 65 which is arranged to form a "recorded" template and which, as indicated by broken lines in FIG. 1, is designed to be installed in the control unit 39 to control the unit. The instruction carrier 65 can be installed in place in the control unit 39 in advance if required.

In fact, as the servo-motor 49 is a stepping motor which carries out angular indexing, it is sufficient to control this servo-motor 49 such that, the resultant movements of the key 47 enable the entire operation to take place as if the disc 46' had, instead of a circular contour, a contour similar to that of the preceding template 46.

In other words, the servo-motor 49 receives instructions from the control unit which make it possible to reconstruct by means of the disc 46' a prerecorded contour as a result of the displacement of this disc 46' transversely relative to the axis of the grinding wheels 18, 19 under the control of the key 47 with which it is associated. The key 47 itself is displaced at each rotational step of the support spindles 23A and 23B which carry the lens 10.

It also allows calibration up or down in the event that the contour of the spectacle frame or surround in which the lens is to be mounted does not correspond exactly to the contour recorded.

As before, the support spindles 23A and 23B which carry the lens and the template, which is in this case a round template, are displaced transversely relative to the feelers 54A and 54B which occupy transversely a fixed position.

To record guidance instructions on the carrier 65 to form a recorded template, a correspondingly shaped template is mounted in place of a lens, and a round template is mounted opposite the key 47.

The shaped template is permanently in contact with the trimming wheel 18 which is fixed, and the key 47 is disengaged from the round template.

For each angular position of the shaped template, the key 47 is raised by means of the motor 49 until it comes in contact with the round template, and the control unit 39 records the corresponding dimension formed, in practice, by the corresponding step of the motor 49.

Preferably, the key 47 includes a contact detection device.

Where the instruction carrier 65 is in place in the control unit in advance, the control unit preferably includes a keyboard such that it is possible for the operator to select the recorded template to be used by entering a code.

The particular curvature of the spectacle frame or surround in which the lens is to be mounted has not been taken into account in the foregoing.

In this respect, the apparatus is preferably provided with a keyboard such that the operator can preselect from the collection of typical paths stored in the control unit 39 one or more typical paths which are suitable for the particular curvature of the spectacle frame or surround in which the lens is to be mounted.

In the embodiments described above, the reading station 53 is an integral part of the grinding machine.

Figure 7:
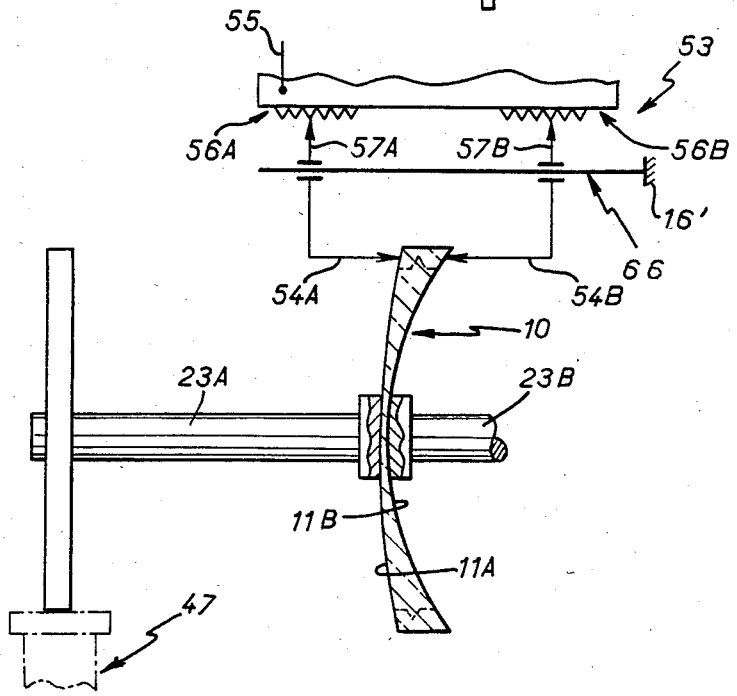
FIG. 7 is a view similar to that of FIG. 2 of a still further embodiment of a grinding machine of the invention.

In the further embodiment shown in FIG. 7, the reading station 53 constitutes a separate part.

In this embodiment, the feelers 54A and 54B are each individually mounted so as to be movable on a support 66 connected to its own fixed chassis 16'.

The other features of the machine illustrated in FIG. 7 are similar to those described above, and the same is true of its mode of operation.

In particular, as regards the corresponding key 47, arrangements similar to those described above are adopted, especially those shown in FIG. 6, so as to allow either the key to be locked in position when a shaped template is used, or the key to be displaceable when a round template in conjunction with a recorded template is to be used.

Of course, the present invention is not limited to the embodiments described and illustrated, but embraces alternative embodiments and/or alternative combinations of the various elements.

Nor is the scope of the invention limited to the bevelling of ophthalmic lenses. It also extends to the grooving of lenses, that is, to the formation of a groove on the edge of an ophthalmic lens. This is necessary when the spectacle frame in which the lens is to be mounted is arranged to retain the lens by way of a tab and/or a tie or flexible wire arranged to encircle the lens. In this case, the tab and/or tie or flexible wire is arranged to engage in the groove in the lens.

Thus, the term 'bevelling' as used in the specification and claims covers both the formation of a projection, such as a bevel, on the edge of the lens and the formation of a recess, such as a groove, in the edge of the ophthalmic lens.

We claim:

1. Apparatus for forming the edge of an ophthalmic lens by bevelling or grooving, said apparatus comprising a grinding wheel mounted for rotation about a first axis, means for mounting the ophthalmic lens for rotation about a second axis parallel to said first axis, means for maintaining said grinding wheel in contact with the edge of the lens, means for displacing the lens axially and radially relative to said first axis as a function of angular position of the lens with respect to said second axis, means for plotting first and second reference paths in a zone of a front face of the lens and in a zone of a rear face of the lens respectively, control means including means for storing a collection of predetermined bevelling or grooving paths and means for comparing first and second reference paths with the collection of predetermined paths and for selecting one of the bevelling or grooving paths which is intermediate the first and second reference paths from the collection of predetermined paths whereby said control means controls the displacement of said lens in accordance with the selected intermediate path to form the edge of the lens.

2. Apparatus according to claim 1, wherein said means for plotting the reference paths is operative in the zones of the lens which are in line with the apex of the bevel or groove to be ground in the edge of the lens.

3. Apparatus according to claim 1, wherein said means for plotting reference paths plots said paths point by point.

4. Apparatus according to claim 1, wherein said means for plotting said reference paths comprises two feelers positioned respectively in contact with the front and rear faces of the lens and individually mounted for independent movement parallel to the axes, means responsive to movement of the respective feelers, and said means responsive to the movement of said respective feelers being connected to said control means.

5. Apparatus according to claim 4, wherein said feelers are located opposite each other.

6. Apparatus according to claim 4, wherein said means responsive to the movement of the respective feelers are responsive to axial movement thereof.

7. A grinding machine for ophthalmic lenses having front and rear faces of desired curvature, said grinding machine comprising a chassis, a machining station supported on the chassis, at least one grinding wheel rotatably mounted at the machining station, a first drive motor for rotating said grinding wheel, a carriage slidable relative to the chassis, two rotatable spindles, arranged to axially clamp the lens carried by the carriage and extending parallel to the axis of said grinding wheel, a second drive motor for rotating the spindles, a control unit for controlling movement of said carriage on said chassis transversely relative to the axis of the grinding wheel and axially parallel to the axis of the grinding wheel, a template filed on one of the spindles, and a key which is arranged to be kept in contact with said template and is mounted to be movable transversely relative to said spindles by means of said control unit, a reading station associated with said machining station, said reading station comprising two feelers arranged to contact respectively the front face and the rear face of the lens for sensing the axial position of zones on the respective faces of the lens, said feelers being mounted for movement, parallel to said spindles independent of each other, and two receivers responsive to the displacements of said feelers and to said control unit, said feelers being respectively adapted to determine reference paths of zones on the front and rear faces of the lens, said control unit comprising means for storing a plurality of predetermined paths, and means for comparing and selecting one of said predetermined paths intermediate the first and second paths, said control unit controlling the displacement of the carriage so that the grinding wheel follows the selected intermediate path for machining the edge of the lens accordingly.

* * * * *